US007444973B2

(12) United States Patent
Boucard et al.

(10) Patent No.: US 7,444,973 B2
(45) Date of Patent: Nov. 4, 2008

(54) DEVICE FOR ACTING UPON A PRESSURE SENSOR MOUNTED ON A FLOW PLUG

(75) Inventors: Michel Boucard, Tournefeuille (FR); Bernd Last, Reutlingen (DE); Cyrille Patri, Toulouse (FR); Alain Ramond, Merville (FR); John Burrows, Cheshire (GB); Sandro Goretti, Rubiera (IT)

(73) Assignees: Siemens VDO Automotive, Toulouse (FR); Federal-Mogul Ignition SRL, Capri (IT)

( * ) Notice: Subject to any disclaimer, the term of this patent is extended or adjusted under 35 U.S.C. 154(b) by 0 days.

(21) Appl. No.: 11/587,654

(22) PCT Filed: Apr. 19, 2005

(86) PCT No.: PCT/FR2005/000934

§ 371 (c)(1),
(2), (4) Date: Mar. 7, 2007

(87) PCT Pub. No.: WO2005/111503

PCT Pub. Date: Nov. 24, 2005

(65) Prior Publication Data

US 2007/0228030 A1 Oct. 4, 2007

(30) Foreign Application Priority Data

Apr. 27, 2004 (FR) ..... 04 04466

(51) Int. Cl.
*F02N 17/00* (2006.01)
*F02N 17/02* (2006.01)

(52) U.S. Cl. ..... 123/179.6; 123/145 A

(58) Field of Classification Search ..... 123/179.6, 123/145 A, 145 R; 73/35.12, 35.13, 118.1, 73/119 R, 115, 116, 119 A, 708; 219/270, 219/260

See application file for complete search history.

(56) References Cited

U.S. PATENT DOCUMENTS 5,517,073 A 5/1996 Ohkuma et al.

(Continued)

FOREIGN PATENT DOCUMENTS

DE 196 80 912 4/2001
EP 1 096 141 5/2001

OTHER PUBLICATIONS

Patent Abstracts of Japan, vol. 008, No. 202 (P-300), Sep. 14, 1984 $ JP 59 085932 A (Nippon Jidosha Buhin Sogo Kenkyusho KK), May 18, 1984 Abstract.

(Continued)

*Primary Examiner*—Mahmoud Gimie
(74) *Attorney, Agent, or Firm*—Dickinson Wright PLLC

(57) ABSTRACT

The invention relates to a device which is used as a force-transmitting device (38') for a pressure sensor (14) associated with a glow plug in an internal combustion engine and is embodied in the form of a tubular piece whose cross-section is substantially annular. The inventive device comprises an area (40) on which the external diameter thereof increases towards one end thereof. The front surface of the device corresponding to said flared end is embodied in the form of a bearing face receiving the piezo-electric pressure sensor. A glow plug integrating said force-transmitting device is also disclosed.

14 Claims, 3 Drawing Sheets

U.S. PATENT DOCUMENTS

| | | | | |
|---|---|---|---|---|
| 6,539,787 | B1 * | 4/2003 | Murai et al. | 73/119 R |
| 6,575,039 | B2 * | 6/2003 | Murai et al. | 73/756 |
| 6,979,801 | B2 * | 12/2005 | Okazaki et al. | 219/270 |
| 2001/0015402 | A1 * | 8/2001 | Murai et al. | 248/554 |
| 2004/0182144 | A1 * | 9/2004 | Okazaki et al. | 73/118.1 |
| 2004/0182145 | A1 * | 9/2004 | Okazaki et al. | 73/119 R |
| 2004/0261502 | A1 * | 12/2004 | Watarai et al. | 73/35.13 |
| 2005/0061063 | A1 * | 3/2005 | Haussner et al. | 73/116 |
| 2005/0252297 | A1 * | 11/2005 | Heinzelmann et al. | 73/708 |
| 2006/0032472 | A1 * | 2/2006 | Yamada et al. | 123/145 A |
| 2006/0053875 | A1 * | 3/2006 | Haussner et al. | 73/116 |

OTHER PUBLICATIONS

Patent Abstracts of Japan, vol. 0081, No. 63 (P-290), Jul. 27, 1984 JP 59 060237 A (Nippon Jidosha Buhin Sogo Kenkyusho KK; Others:01), Apr. 6, 1984 Abstract.

Patent Abstracts of Japan, vol. 0082, No. 62 (M-341). Nov. 30, 1984, & JP 59 134341 A (Nippon Jidosha Buhin Sogo Kenkyusho KK), Aug. 2, 1984 Abstract.

* cited by examiner

DEVICE FOR ACTING UPON A PRESSURE SENSOR MOUNTED ON A FLOW PLUG

The present invention concerns a device for bearing on a pressure sensor mounted on a glow plug.

It is known to integrate a pressure sensor in a glow plug in an internal combustion engine, in particular a diesel engine. This sensor makes it possible to measure the internal pressure of the engine. The knowledge of this pressure enables the progression of the combustion in that engine to be better controlled. Better efficiency of that engine is thus attained and limitation is achieved not only of its fuel consumption but also of its polluting emissions.

A glow plug generally comprises a tubular body having on its outer surface a threaded portion enabling it to be fixed into a corresponding bore formed in a cylinder head. One portion of that body is located within the combustion chamber and the other portion outside it. The portion within the combustion chamber bears a finger within which is located a heater electrode. The latter is supplied by a core which passes through the tubular body of the glow plug. The portion outside the engine is also referred to as glow plug head. At that head, the core is connected to a source of electrical energy. It is also known to place the pressure sensor in that head.

One form of embodiment of such a glow plug has been provided in a patent application that has not yet been published at the time of filing the present application. This application was later published under the number FR 2 861 836. That embodiment is illustrated in FIG. 1 appended hereto.

In the embodiment represented in FIG. 1, and described in more detail later, the pressure sensor is mounted between a nut with an external screw thread screwed into a housing of the glow plug head, and a spacer bearing on the finger within which is located the heater electrode and mounted on the tubular body.

In this embodiment, the spacer is formed of ceramic and has a tubular circular cylindrical form. The spacer does not bear directly against the sensor but is separated therefrom by an electrically insulating member as well as by a bearing part used to distribute the pressure from the spacer over the whole surface of the pressure sensor.

This solution has the drawback that at least three parts are situated between the finger and the glow plug and the pressure sensor. This implies a cost both for the production of these different parts as well as for their assembly. Furthermore, it has been noted that the presence of several contact surfaces (between the pressure sensor and the insulating member, between the insulating member and the bearing part and between the bearing part and the spacer) had a negative effect on the sensitivity of the pressure sensor.

The present invention thus concerns a glow plug equipped with a pressure sensor implementing a spacer for transmitting forces to the sensor but of which the production cost is less than the embodiment presented earlier. Preferably, the structure of this glow plug will not weaken the sensitivity of the pressure sensor used.

To that end, it provides a force transmitting device for a pressure sensor associated with a glow plug in an internal combustion engine, having the form of a tubular member of substantially circular section.

According to the invention, the device comprises a zone in which its outer diameter increases towards one of its ends, and the front face of the device corresponding to that flared end is a bearing face adapted to receive a pressure sensor.

Such a force transmitting device is thus also adapted to service as a bearing part. It is possible in this way to eliminate a part between the origin of the force (pressure) to measure and the sensor.

In an advantageous embodiment, this force transmitting device is produced from a ceramic material. Thus, it may also serve as an electrically insulating member for the pressure sensor when this a piezo-electric sensor. This is because it may also be a resistive piezo-electric sensor or any other type of pressure sensor.

To enable the passage of a conductive core, this device preferably has a central hole of substantially constant diameter.

The present invention also concerns a glow plug comprising a piezo-electric pressure sensor and characterized in that it comprises a force transmitting device as described above.

In such a glow plug, the flared end of the force transmitting device bears for example against a face of the pressure sensor and substantially corresponds to the surface of that sensor. In this way, the forces to transmit are perfectly so transmitted and the sensor can operate in good conditions.

The glow plug may in particular be of the type comprising at one of its ends a finger incorporating a heater electrode, and the force transmitting device is then for example disposed between that finger and the pressure sensor. In this embodiment, the finger may be fixed within a tubular part, at one end thereof, and that tubular part may have an interior shoulder against which the force transmitting device rests. The tubular part concerned here may be the body of the glow plug but it may also be another part, such as an intermediate part between the body and the finger of said glow plug.

In the case in which the finger is fixed into a tubular part, the outer diameter of the force transmitting device is preferably less than the inner diameter of the tubular part within which it is housed such that the force transmitting device is free at its periphery, in particular with respect to the tubular part. Thus the risk of transmitting extraneous forces is diminished.

Similarly, when a conductive core supplies the heater electrode of the glow plug with electrical energy, that core preferably passes freely within the force transmitting device.

The present invention lastly concerns an internal combustion engine, in particular an engine of diesel type, characterized in that it comprises at least one glow plug as described above.

Details and advantages of the present invention will appear more clearly from the following description, made with respect to the accompanying drawings in which.

Figure 2:
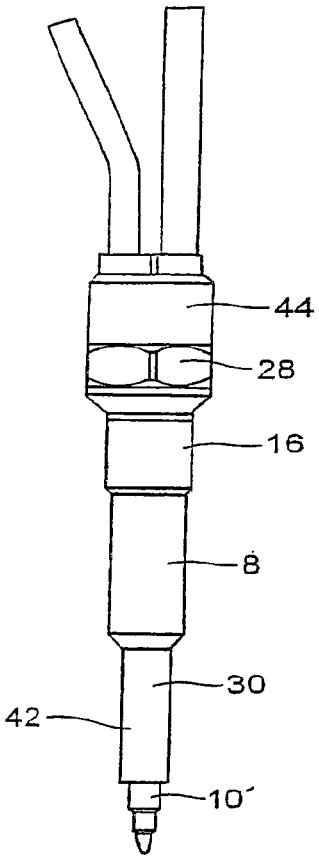
FIG. 2 shows an external view of a glow plug according to the invention.
Figure 3:
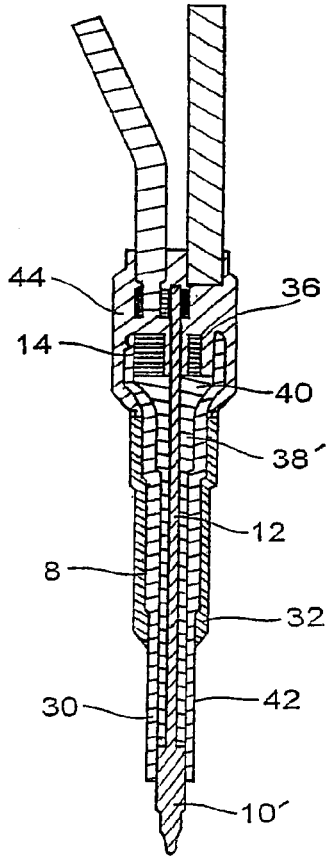
FIG. 3 is a longitudinal cross-section of the glow plug of FIG. 2.
Figure 4:
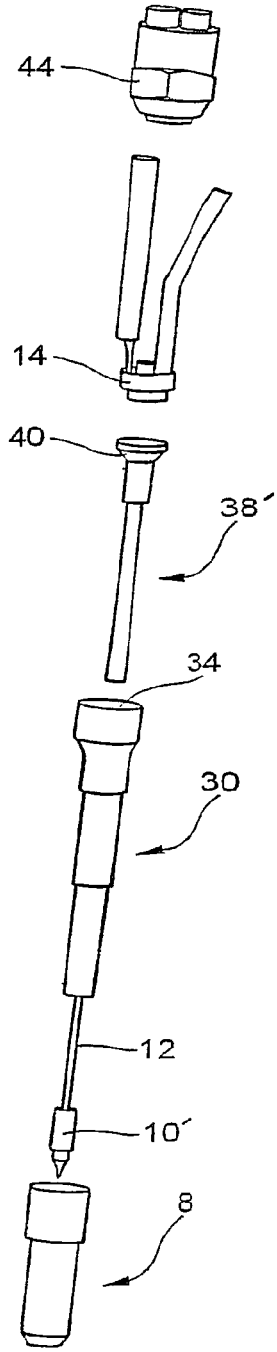
Figure 5:
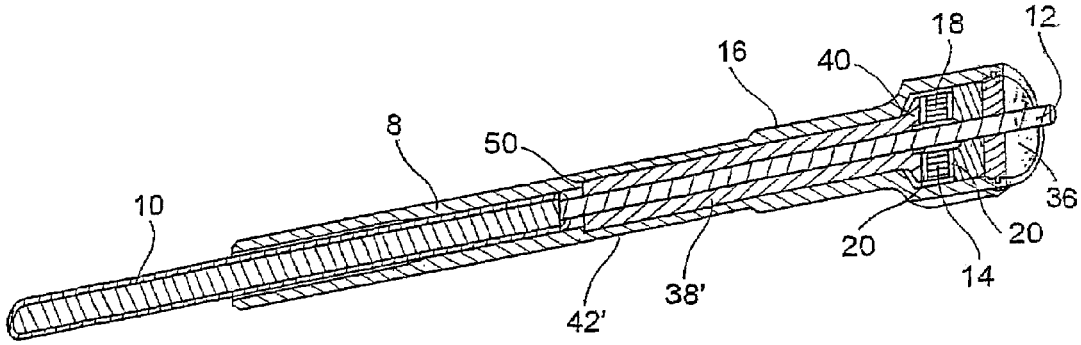
Figure 6:
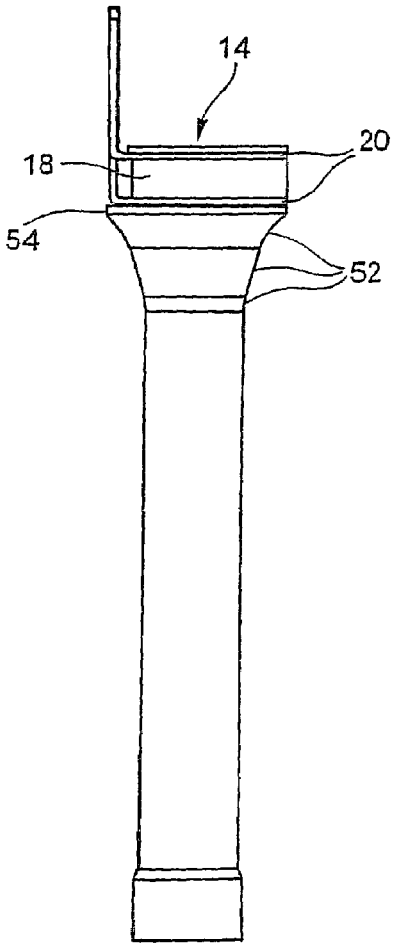
Figure 7:
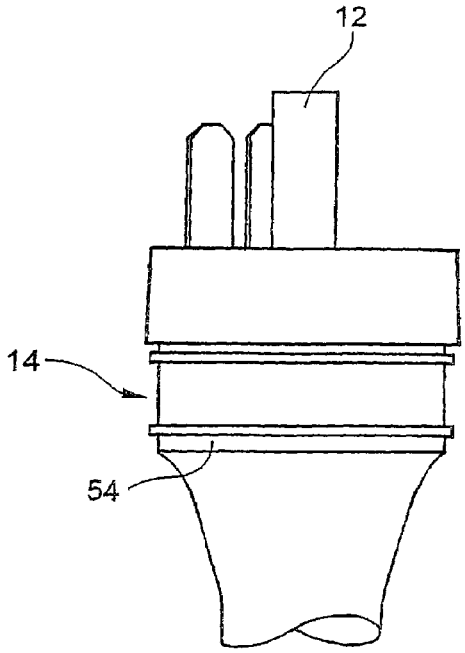

FIG. 4 is an exploded view of the various components of the glow plug of FIGS. 2 and 3, FIG. 5 illustrates the mounting of a spacer according to the invention in perspective and in cross-section, FIG. 6 shows a spacer according to the invention on which a piezo-electric sensor rests, and FIG. 7 is a view at a larger scale of the mounting of the piezo-electric sensor of the preceding Figure viewed from a different angle.

Figure 1:
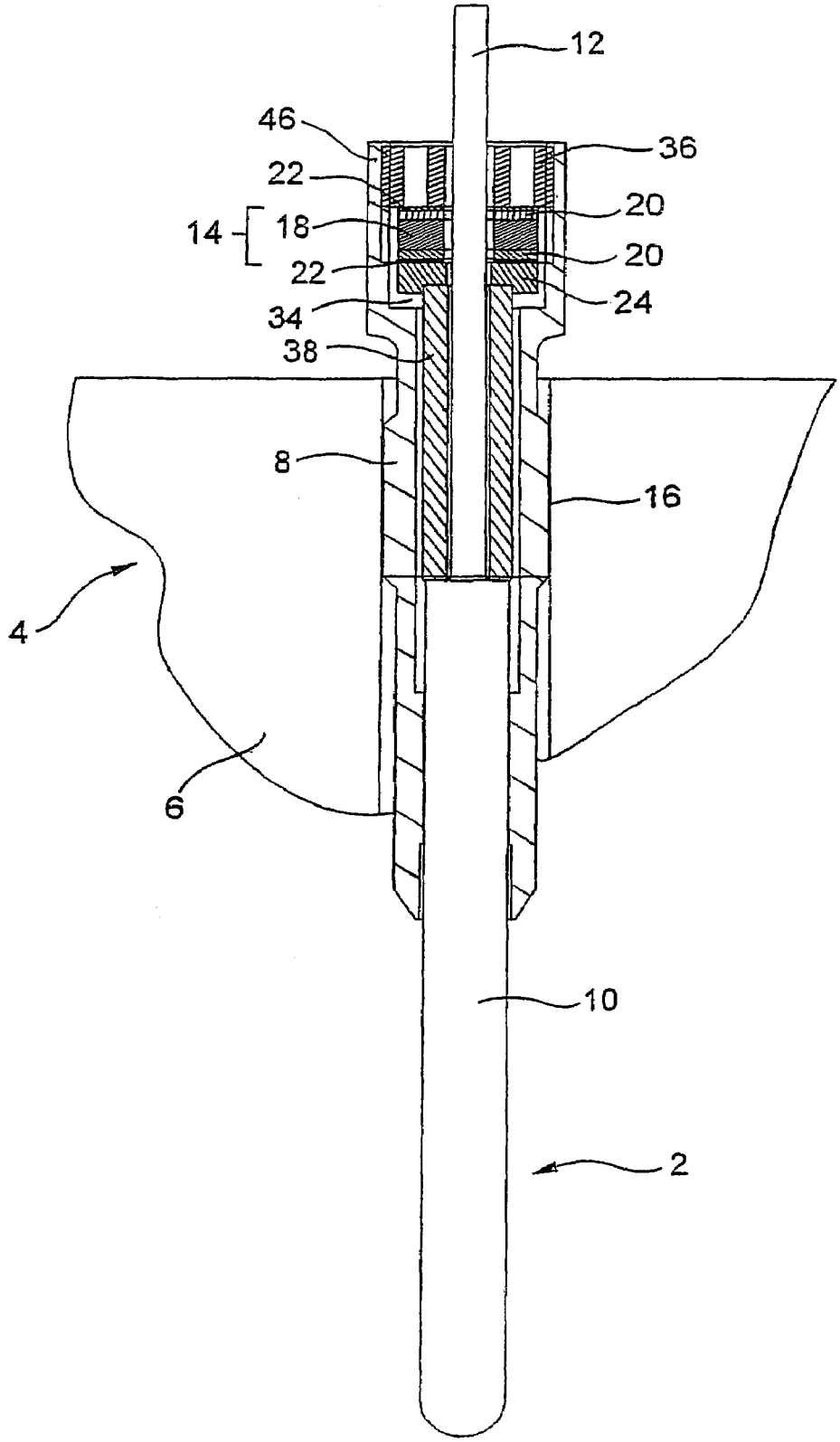
FIG. 1 shows a glow plug earlier than the present invention, in longitudinal cross-section.

FIG. 1 represents a longitudinal cross-section of a glow plug of a model prior to the invention (but not disclosed at the time of the first filing of the present patent application). This glow plug comprises a pressure sensor so as to be able to measure the pressure in an engine cylinder. This glow plug 2 is mounted in a conventional manner in an engine 4, of diesel type, and more particularly in a cylinder head 6 of that engine. It comprises a body 8, a finger 10, a core 12 and a pressure sensor 14.

The body 8 is adapted to be fixed to the engine 4 by screwing. To that end, the cylinder head 6 comprises a threaded bore passing through it and opening into a combustion chamber of said engine. Concerning the body 8, this has a screw thread 16 on its other surface corresponding to the bore formed in the cylinder head 6. When the screw thread 16 cooperates with the threaded bore of the cylinder head 6, the glow plug being in its mounted position in the engine 4, a portion of the body 8 extends inwardly of the engine, that is to say towards the combustion chamber, whereas another portion extends outwardly the engine. The body 8 is a tubular body and is for example formed from steel.

In this embodiment, the finger 10 is mounted within the tubular body 8, within which it has an interference fit, and projects into the combustion chamber. This finger 10 incorporates a heater electrode (not shown). The core 12 is adapted to supply that electrode with electrical energy and passes through the body 8 from the finger 10 as far as the opposite end of the body 8 from that at which the finger 10 projects. This core 12 is then connected, by means not shown, to a supply conductor.

The pressure sensor 14 is provided for measuring the pressure within the corresponding combustion chamber. In the embodiment of FIG. 1, this pressure sensor 14 comprises a piezo-electric member 18 disposed between two contact elements 20 formed from an electrically conductive material. The sensor is then itself electrically isolated from the rest of the glow plug 2 by electrically insulating members 22.

In this embodiment, the pressure sensor 14 also comes to bear on the body 8 via a bearing part 24. The pressure sensor 14 is connected to the body 8 by its upper surface and bears against the finger 10 such that the pressure exerted on that finger compresses it against the body 8. To that end, the pressure sensor 14 bears on a spacer 38 which rests on the finger 10 and which is disposed in the body 8, without contact with the latter. This spacer 38 surrounds the core and is not in contact with it either.

The compression of the pressure sensor 14 against the finger 10 (via the spacer 38 and the bearing part 24) as well as its connection to the body 8 is provided by a nut with external screw threading 36. This nut is of course not in contact with the core 12 but cooperates with an internal thread formed on the internal face of the side wall 46 of a housing 34 formed in the body 8 for receiving the sensor 14.

In the embodiment of FIGS. 2 to 4, similar members take the same reference numbers as those used in FIG. 1.

On the external view of FIG. 2, there can be recognized on the outer surface of the glow plug body 8 a screw thread 16, and, in the vicinity thereof, adjacent the head of the glow plug 2, a gripping zone 28. In a conventional manner, this gripping zone 28 has a hexagonal cross-section.

In the example embodiment of FIGS. 2 to 4, the finger bears the reference 10'. This is a finger of a different type to that represented in FIG. 1 since it is a ceramic finger. Another difference is that to insulate the electrical connections and protect the sensor, the head of the glow plug has an overmolding 44 of synthetic material.

In FIGS. 2 to 4, a tubular intermediate part 30 is provided between the body 8 and the finger 10' to insulate the finger 10' from the body 8.

Between the finger 10' and the pressure sensor 14 is a spacer 38'. There is no bearing part 24 to be found here, nor any electrically insulating member 22 between the spacer 38' and the pressure sensor 14, or more specifically a contact element 20 of that sensor.

The spacer 38' is a tubular part which allows the core 12 to pass through its center. As in the embodiment of FIG. 1, the spacer 38' is freely mounted around that core. Similarly, it is freely mounted in the tubular intermediate part 30 and its outer diameter is thus less than the inner diameter of that tubular intermediate part 30.

In its upper portion, the diameter of the spacer 38' is adapted to the diameter of the lower face of the pressure sensor 14. Thus, the spacer 38' has, on its upper portion, a frusto-conical zone 40 enabling the outer diameter of the spacer 38' to progressively pass from a diameter corresponding approximately to the diameter of the finger 10' to the diameter of the pressure sensor 14 on approaching the end of the spacer 38' against which the pressure sensor 14 bears.

As has just been seen, by virtue of its frusto-conical portion 40, the spacer 38' thus provides the function that is given by the bearing part 24 in the embodiment of FIG. 1. In order for the spacer 38' also to be able to fulfill the function of the electrically insulating member 22 of FIG. 1, the spacer 38' is formed from an electrically insulating material, such as a ceramic.

In the embodiment of FIGS. 2 to 4, the tubular intermediate part 30 has an interference fit with the lower end of the body 8, adjacent a fixing zone 32. Between that fixing zone 32 and the zone in which the finger 10' has an interference fit within the tubular intermediate part 30, there is a deformation zone 42. The latter promotes the transmission of the forces exerted by the ambient pressure in the combustion chamber on the finger 10' to the pressure sensor 14.

FIG. 5 shows a third embodiment of a glow plug according to the invention. A spacer 38' according to the invention is again to be found in this glow plug. In this and the following Figures, the reference numerals of the preceding Figures are used for similar members.

The variant embodiment of FIG. 5 may be considered as a combination of the embodiments of FIG. 1 and of FIGS. 2 to 4. In this embodiment there is once again a body 8 bearing a finger 10 at one side and a pressure sensor 14 at another side. This sensor comprises a piezo-electric element 18 sandwiched between two contact elements 20. This sensor is located between a nut with an external screw thread 36 and a spacer 38'. A core 12 is connected to the finger 10 and passes through the spacer 38', the pressure sensor 14 and the nut with an external screw thread 36.

The spacer 38' is of the same type as that described with reference to FIGS. 2 to 4. It thus comprises a tubular circular cylindrical portion and ends with a frusto-conical portion 40 located adjacent the pressure sensor 14. It can be seen in FIG. 5 in what way this spacer is mounted in the body 8. Adjacent the pressure sensor 14, the spacer 38' has a bearing surface which substantially corresponds to the surface of the pressure sensor 14. This bearing surface is substantially perpendicular to the longitudinal axis of the spacer 38' and is of annular shape. The central recess of that annulus corresponds to the passage for the core 12.

At its other end, the spacer 38' comes to rest against a shoulder 50. The latter is formed in the vicinity of the end of the finger 10 located within the body 8. Thus, the opposite end of the spacer 38' to the frusto-conical zone 40 is located close to the finger 10 but does not rest thereon. The spacer 38' nevertheless passes on the forces exerted by the ambient pressure in the corresponding combustion chamber to the pressure sensor. This is because the body 8 has a deformation zone 42' located between the zone in which the finger 10 fits with an interference fit within the body 8 and the screw thread 16. It is considered that the screw thread is not deformable since it is mounted in the cylinder head 6 which is of high stiffness. As the shoulder 50 against which the spacer 38' rests is located close to the finger 10 and to the zone in which that finger 10 has an interference fit with the body 8, it enables the pressure sensor 14 to nevertheless to experience the stresses exerted on the finger 10. This is because the pressure sensor 14 is located between the nut with an external screw thread 36 and the spacer 38'. The nut with outer screw thread 36 is fastened to the wall 46 which is fixed with respect to the cylinder head. This is because this wall is situated to the exterior of the cylinder head and is not subject to any significant stress. If it is then considered that the ceramic material of the spacer 38' is stiff and does not deform, the forces exerted on the finger 10 are passed on to the pressure sensor 14 by the spacer 38'.

As is apparent from the above description, adjacent the pressure sensor 14, the spacer 38' flares such that its outer diameter adapts itself to the diameter of the pressure sensor. Thus the spacer 38' may come to bear on the whole surface of the pressure sensor 14. This flared form is preferably produced close to the pressure sensor 14. This is because, in this way, the mass of the spacer 38' is limited. Furthermore, this embodiment is adapted to the internal form of the body, or more generally of the tubular part, in which the spacer 38' is found.

In the embodiment of FIGS. 3 and 4, it was considered that the flared zone of the spacer 38' was frusto-conical. The examples of FIGS. 6 and 7 show other embodiments.

In FIG. 6, the flared form is a succession of frusto-conical sections 52 of which the splay angle at the vertex increases on approaching the pressure sensor 14. The spacer 38' ends adjacent the pressure sensor 14 with a circular cylindrical zone 54 (with a central hole for the passage of the core 12) of small thickness. In this way it is avoided to have a sharp angle on the upper edge of the spacer 38', which is difficult to produce and is fragile.

In FIG. 7, another non-frusto-conical widening form is shown by way of example. Here the widening of the diameter is progressive and no intersection lines are found such as those delimiting the frusto-conical sections 52 of FIG. 6. However, there is again found here a circular cylindrical section 54 adjacent the pressure sensor for the same reasons as those given earlier.

As can be noted in the embodiments provided in FIGS. 2 to 7, no part other then the spacer 38' is situated between the finger of the glow plug described and its pressure sensor. In this way the number of parts necessary to manufacture the glow plug provided with its pressure sensor is limited as is the number of interfaces in the transmission of the force exerted by the ambient pressure within the combustion chamber as far as the pressure sensor.

It is thus achieved to limit the production cost of the glow plug equipped with a pressure sensor and despite the reduction in cost, the sensor equipping that glow plug may have better sensitivity when making a pressure measurement.

The present invention is not limited to the embodiments described above by way of non-limiting example. It concerns on the contrary all the variant embodiments accessible to the person skilled in the art.

Thus, for example, the spacer according to the invention could be produced from a material other than ceramic. An electrically conductive material may even be envisaged. To electrically insulate the sensor on the spacer side, when the sensor is for example a piezo-electric sensor, all means may be envisaged. A surface treatment may for example be suggested making it possible to render the bearing face of the spacer electrically insulating, on which face the pressure sensor rests.

The widening of the outer diameter of the spacer is preferably made in the immediate proximity of the pressure sensor. However, this widening may be made at another place on the spacer.

The spacer according to the invention is described with respect to two different types of glow plug. Of course, this spacer may be used on other types of glow plug comprising a sensor, for example a piezo-electric sensor, and a spacer for the transmission of forces towards that sensor.

The invention claimed is:

1. A glow plug for an internal combustion engine comprising:

a generally tubular body (8) having threads (16) adapted to engage complementary threads in an engine cylinder head (6);

a finger (10, 10') incorporating a heating element, said finger (10, 10') disposed centrally within said body (8) and extending from a lower end thereof for exposure within the internal combustion engine (4);

a piezo-electric pressure sensor supported within an upper end of said body (8);

a force transmitting device (38') having the form of a tubular member of substantially circular section, said force transmitting device (38') comprising a zone (40) in which its outer diameter increases towards one of its ends, and in that the front face of the device corresponding to that flared end is a bearing face adapted to receive a pressure sensor (14); and a deformation zone (42, 42') surrounding at least a portion of said finger (10, 10') and directly abutting said force transmitting device (38'), said deformation zone (42, 42') configured for exposure within the internal combustion engine (4) for transmitting compression forces resulting from engine (4) pressure directly to said force transmitting device (38').

2. A glow plug according to claim 1, characterized in that the force transmitting device (38') is formed from a ceramic material.

3. A glow plug according to claim 1, characterized in that the force transmitting device (38') has a central hole of substantially constant diameter.

4. A glow plug according to claim 1, characterized in that the flared end of the force transmitting device (38') bears against a face of the pressure sensor (14) and substantially corresponds to the surface of said sensor.

5. A glow plug according to claim 1, characterized in that the force transmitting device (38') is arranged between said finger (10, 10') and the pressure sensor (14).

6. A glow plug according to claim 5, characterized in that the finger (10, 10') is fixed inside a tubular member (8), at one end of the latter, and in that said tubular member (8) has an inner shoulder (50) which the force transmitting device (38') rests against.

7. A glow plug according to claim 6, characterized in that the outer diameter of the force transmitting device (38') is less than the inner diameter of the tubular member (8, 30) within which it is housed.

8. A glow plug according to claim 5, characterized in that it comprises a conducting core (12) supplying the heating electrode of the glow plug with electrical energy, and in that said core (12) passes freely within the force transmitting device (38').

9. A glow plug according to claim 2, characterized in that the force transmitting device (38') has a central hole of substantially constant diameter.

10. A glow plug according to claim 2, characterized in that it comprises at one of its ends a finger (10, 10') incorporating a heating electrode, and in that the force transmitting device (38') is arranged between said finger (10, 10') and the pressure sensor (14).

11. A glow plug according to claim 3, characterized in that it comprises at one of its ends a finger (10, 10') incorporating a heating electrode, and in that the force transmitting device (38') is arranged between said finger (10, 10') and the pressure sensor (14).

12. A glow plug according to claim 4, characterized in that it comprises at one of its ends a finger (10, 10') incorporating a heating electrode, and in that the force transmitting device (38') is arranged between said finger (10, 10') and the pressure sensor (14).

13. A glow plug according to claim 6, characterized in that it comprises a conducting core (12) supplying the heating electrode of the glow plug with electrical energy, and in that said core (12) passes freely within the force transmitting device (38').

14. A glow plug according to claim 7, characterized in that it comprises a conducting core (12) supplying the heating electrode of the glow plug with electrical energy, and in that said core (12) passes freely within the force transmitting device (381).

* * * * *